United States Patent [19]

Burrage et al.

[11] 4,325,734

[45] Apr. 20, 1982

[54] METHOD AND APPARATUS FOR FORMING COMPACT BODIES FROM CONDUCTIVE AND NON-CONDUCTIVE POWDERS

[75] Inventors: Lawrence M. Burrage, S. Milwaukee, Wis.; Jacques P. Guertin, Cupertino, Calif.

[73] Assignee: McGraw-Edison Company, Rolling Meadows, Ill.

[21] Appl. No.: 134,645

[22] Filed: Mar. 27, 1980

[51] Int. Cl.[3] ..... B22F 3/14

[52] U.S. Cl. ..... 75/225; 75/226; 425/78

[58] Field of Search ..... 75/226, 225, 214; 425/78

[56] References Cited

U.S. PATENT DOCUMENTS

| | | | |
|---|---|---|---|
| 3,929,476 | 12/1975 | Kirby, Jr. et al. | 75/226 |
| 4,032,337 | 6/1977 | Boyer | 75/226 |
| 4,104,061 | 8/1978 | Roberts | 75/211 |

OTHER PUBLICATIONS

Hirschhorn *Introduction to Powders Metallurgy* 1969 pp. 246, 247.

*Primary Examiner*—Brooks H. Hunt

*Attorney, Agent, or Firm*—Ronald J. LaPorte; Jon C. Gealow; Charles W. MacKinnon

[57] ABSTRACT

Compact bodies for use as contacts in vacuum current interrupters, plasma devices and the like are formed by a vacuum hot press fabrication of suitable powder material. The contacts which may be formed as a button or ring, are operable under high current arcing conditions. The powder material is mixed and placed between a pair of rams in a floating die cavity maintained in an inert atmosphere and is placed in a vacuum chamber. A vacuum is created without pressurizing the powder material. The powder material is heated to below its melting temperature for degassing. The die cavity preferably includes special outgassing ports. The rams are pressurized and the powder material reaches a sintering temperature and a vacuum of $3\times10^{-6}$ torr. A uniform composition compact body essentially devoid of trapped gas and particularly suitable for use as a high current interrupting contact in an arcing environment results. Interrupter contacts of copper with hundreds of ppm of oxygen (cupric or cuprous) may be formed. Powder material of a non-carbide-forming metal or alloy may be mechanically bonded to a porous graphite element as a result of the process. A weak joint between the powder material, and a porous graphite element may also be created by interposing an anti-bonding graphite powder layer therebetween.

52 Claims, 17 Drawing Figures

METHOD AND APPARATUS FOR FORMING COMPACT BODIES FROM CONDUCTIVE AND NON-CONDUCTIVE POWDERS

BACKGROUND OF THE INVENTION

I. Field of the Invention

The present invention relates to the fabrication of powder compact bodies and particularly such compact bodies suitable as contacts in vacuum current interrupters, other plasma devices and the like, and, more particularly, to a method and apparatus for the fabrication of such contacts from a powder material wherein various desirable properties of the contact material are optimized.

II. Description of the Prior Art

Contacts for vacuum current interrupters and the like are presently fabricated using the well known techniques of vacuum melting and vacuum infiltration. Such contact-forming processes are specifically designed to optimize various operating charcteristics of the resulting contacts. These characteristics include a low gas content and high thermal and electrical conductivities. The contact must be able to withstand the high current arcs encountered on interruption and exhibit a low chopping current level. Antiwelding characteristics are also desirable for preventing the contacts from welding together upon completing a circuit. Generally, a single material or element does not possess all of these desirable properties and a compromise characteristic is presently obtained by forming an alloy or mixture of a high conductivity metal such as copper and/or silver, and a minor component of a relatively high vapor-pressure conductive material, i.e., a brittle metal such as bismuth, antimony, and/or arsenic. Vacuum melting is employed to produce a true alloying, i.e., formation of a solid solution. There are certain disadvantages to vacuum melting. Some of these disadvantages are as follows:

1. Little, if any, control of true alloying is possible. Other physical properties, for example, melting point and wettability of the several metal constituents or components, may make complete melting and/or coalescing extremely difficult.

2. The difference in component densities in multiple component contact bodies, and an inadequate mixing or stirring during formation may create a non-uniform component distribution with segregation into layers.

3. The evaporative losses of different components may vary, making precise quantitative control of the component composition difficult.

4. Undesirable interactions may occur among some of the contact components and between the melt and the melting apparatus. An example of such component interaction occurs where the melt includes copper and small amounts of magnesium fluoride which may react to form copper fluoride. An instance of the second interaction may arise where a conventional graphite crucible is employed to contain a melt of copper and zirconium which when melted, reacts with the graphite to form a copper/zirconium/zirconium-carbide body upon solidification.

5. The grain structure of the contact resulting from the vacuum melting process may be of a type which produces defects such as cracks, laminations and asperities.

6. In vacuum melting, the solidification generally creates a "shrink" hole in the upper surface of the body which must be removed as wasted material. The solidified contact body further requires substantial machining operations to form a finished contact.

7. While a properly solidified vacuum melt contact tends to have a highly desired low porosity, the process does not provide control of this property.

8. The solidified contact formed by this method is not a finished component and may for example require substantial machining operations with the attendant expense and possible damage to the contact as a result of the presence of a brittle component.

Suitable contacts for vacuum current interrupters and/or plasma devices have also been formed with conventional powder/metallurgy techniques wherein a powder is first subjected to high compaction pressures and only thereafter heated to sintering temperatures. Although many problems associated with the vacuum melting method may be avoided, other problems arise, which are typically as follows:

1. Generally, the resulting compact bodies have appreciable residual porosity unless ultra pure powders are used, and a series of extreme procedures, such as very high initial compaction pressures in special multi-action presses with floating dies and the like and very high sintering temperatures are employed.

2. The resulting compact bodies tend to have somewhat higher gas content and may actually explode during initial sintering due to entrapped gases. The compact bodies also are more likely to have body defects, such as cracks, and laminations.

3. Cold compaction tends to work harden the compact body being formed such that densification is increasingly retarded and finally stopped.

4. Friction between the outer compact body surfaces and the die wall and die plunger results in non-uniform density distributions making formation of compact bodies with large length-to-diameter ratios with uniform density virtually impossible.

SUMMARY OF THE INVENTION

Accordingly, it is a primary object of the present invention to provide a method for fabricating compact bodies from powder material, which compact bodies provide unique contacts for vacuum current interrupters, plasma devices and the like wherein two or more elements, each of which has certain desirable characteristics are combined under controlled conditions with uniform distribution of the elements throughout the compact body. The method of the invention significantly minimizes interaction of the powder material, and a die cavity wall in which the compact body is formed. Further, the method controls the porosity and minimizes the gas content of the resulting compact bodies.

It is a further object of the present invention to provide a method of the above-described type which results in the production of a compact body requiring little machining for use as an electrical contact.

It is a further object of the present invention to provide an improved die assembly for fabricating compact bodies according to the method described heretofore which die assembly includes means for rapidly de-gassing the powder material immediately prior to pressing the powder material into a compact body.

Generally, in accordance with the present invention, powder material is uniquely formed into a compact body which is particularly suitable for an electrical contact, by a vacuum hot press process which includes the simultaneous application to the powder material of a sintering temperature and high mechanical pressure in a high vacuum environment. The temperature is maintained below the melting temperature of the powder material such that diffusion and mechanical bonding occurs within the compact body although intermetallic compounds may also be formed.

More specifically, high purity powder material preferably of non-uniformly sized particles, is appropriately confined within a floating die cavity assembly having a compaction plunger for mechanically compressing the powder material. The die assembly in a generally non-pressurized state is placed in a vacuum chamber and the powder material is de-gassed while in a fluidized state as the chamber pressure level is slowly decreased to a selected low pressure thereby to create a desired vacuum condition. The essentially unpressurized die assembly is thereafter slowly and steadily heated until the temperature is somewhat below the melting temperature of the powder material. After the chamber pressure has decreased sufficiently, the die assembly is increasingly pressurized, preferably in small pressure increments with frequent pressure releases to further assist in a more thorough outgassing of the powder compact body. The die pressure is increased to a maximum level and held for a short period. The maximum die assembly pressure may be significantly less than that required for cold compaction. The resulting compact body is essentially gas free such that when employed as a contact, it exhibits no detrimental effects upon arcing during current interruption within a vacuum enclosure.

The vacuum hot press process permits control of bonding and alloying. Diffusion bonding which involves particle-to-particle contact only at the surfaces thereof, generally results and the degree of bonding, and the alloying if any, is therefore controlled by decreeing the temperature or by employing diffusion inhibitors, or a combination of both. The particle-to-particle surface phenomena also prevent, or at least significantly minimize, bulk chemical interactions. For example, the combination of powdered copper and magnesium fluoride does not show any significant formation of copper fluoride. As melting of the powder material is not involved in the formation of the bond, the components may have widely differing melting points as well as other different physical properties.

Powders may be properly blended to produce a uniform distribution of particles, which is readily maintained throughout the process to the final compact body. The reasonably confined powder material cannot move randomly over any appreciable distance. Further, the powder material is maintained in a plastic state such that friction with the confining surfaces of the die assembly is minimal. As a result, the initial uniform distribution of components is maintained. The latter permits equipment simplification and the forming of compact bodies with large length to diameter ratios.

The composition of the final compact body is also essentially identical to that of the original powders because evaporation losses are significantly minimized by employing low, non-melt temperatures and confining the powder material within the die assembly. The powder material, even though it may include metal powder, may be initially non-conductive as the result of an insulating film or surface coating which occurs either by accident or by design. However, after formation into a compact body by the vacuum hot press process of this invention, the compacted powder material becomes conductive. Further, the powder material does not move to the surface and only the outer surface particles react with the die assembly walls. The outer surface of the compact body may be readily and economically cleaned as by chemical etching, light machining or the like.

Physically, the compact body may be shaped into a final geometric configuration with reasonably close tolerances. This eliminates the waste of materials of the type associated with "shrinkholes" in vacuum melting and minimizes waste in machining to form a finished electrical contact. The porosity of the compact body can be readily controlled. Although a non-porous compact is generally desired, special porous compact bodies may be created at will.

The contacts formed from the compact bodies created by the process of the present invention generally have physical characteristics which distinguish them from contacts formed by vacuum melting or by cold compaction, followed by sintering and/or infiltration. These characteristics are conveniently summarized in the following table:

| | Vac. Melt | Cold Press Sinter | Vac. Hot Press |
|---|---|---|---|
| (i) | No porosity | Much porosity | Little to no porosity |
| (ii) | Non-uniform distribution of non-alloyed additives | Uniform | Uniform |
| (iii) | Large grain size | Very small grain size | Somewhat larger grain size |
| (iv) | Little trapped gas | Much trapped gas | Little trapped gas |
| (v) | — | Non-uniform density distribution | Uniform |
| (vi) | — | Often cracks, laminations, etc. | Usually free of such defects |
| (vii) | Alloying of constituents almost always takes place | Non-alloying of constituents is possible | Non-alloying of constituents is possible |

The foregoing features and objects are accomplished in accordance with one embodiment of this invention in which the appropriate powder material, including selected amounts of high conductivity and anti-welding particles, are thoroughly mixed to form a composition desired for the final contact. The powder material is at all times surrounded by an inert environment, prior to, during, and after weighing and mixing. While being maintained in an inert environment, the blended powders comprising the powder material are placed in a die assembly including an open-ended die cavity, each end of which after filling is closed by a plunger, and positioned within a vacuum chamber having suitable rams aligned with and engaging the plungers. The chamber is then evacuated to place atmospheric pressure on the rams. Such pressure is sufficient to hold the die assembly rigidly in place but does not significantly compact the powder material. Under this pressure, the powder material begins to conform to the die cavity configuration, yet is still sufficiently loose such that gases are not trapped between the particles, but are withdrawn as a result of the vacuum condition.

After the chamber pressure has been sufficiently reduced, the die assembly is heated slowly. The chamber pressure is maintained at a very low level so as to minimize the probability of oxidation and/or other particle-atmosphere interactions within the bulk powder material. The temperature is increased until it approaches, but is held below the melting point of the powder constituent having the lowest melting point. The chamber pressure is preferably further reduced and additional ram pressure beyond atmospheric pressure is applied to the plungers with the ram pressure being frequently released in order to outgas the powder compact body more thoroughly. A maximum ram pressure and maximum temperature are reached and maintained for a relatively short time. An indication that the processing is essentially complete is the observation of linear expansion, i.e., an increase in ram pressure occuring, but not being produced by external means, resulting from various hot press assembly parts slowly increasing in temperature. Thereafter, the die assembly is allowed to cool to room temperature while maintaining pressure on the compact body. The die assembly is then removed from the vacuum chamber, the compact body is removed from the die assembly, and if necessary, the compact body is subjected to "clean up" machining, which is generally minimal. The compact body may be shaped to form a single contact or may be a block which is cut to form a plurality of contacts.

The present invention may also be employed to form copper particle contacts in which the particles uniquely contain oxygen in excess of two parts per million (ppm). Generally, the prior art teaches that the oxygen content in such contacts is to be minimized and although a level of less than 2 ppm is usually considered acceptable, an oxygen content of less than 1 ppm is often recommended. However, it has been discovered that by proper design and selection, the quantity of oxygen may not be as significant as the form. Although free oxygen should be avoided, copper contacts having oxygen in the form of compounds such as cuprous or cupric and on the order of hundreds of ppm, provide a highly satisfactory contact for vacuum interrupters. Analysis of copper/oxygen contacts formed by the hot press vacuum process of this invention has indicated the presence of oxygen in the form of one or more copper oxides. Copper particle contacts of the type described may avoid the necessity of special additives and formation of pure copper as well as the need for special back-up mounting structures, while providing improved opening and closing characteristics.

In the preferred embodiment of the present invention, the die assembly includes a floating die body having a removable insert forming the die cavity wall conforming to the final contact, such as, for example, a solid button or a ring contact. Outgassing ports are preferably provided in the insert and/or die cavity wall above the level of the powder material but below the lower surface of the top plunger to aid in outgassing the powder material when the filled die assembly is placed in the vacuum chamber. In a particular embodiment of the invention, one or more breakable die supports, such as pins, are secured in the lower plunger to support the die body in a vertical position. Similarly, one or more breakable plunger supports, such as pins, are secured to the upper plunger to support that plunger on the top surface of the die body. With the die body supported by the die support pins on the lower plunger and with the lower plunger received in the cavity on the die body, the powder material to be compacted is placed therein. Thereafter, the upper plunger is lowered into the die cavity until supported by the plunger support pins. The plunger support pins maintain the face of the upper plunger spaced from the top of the powder material but with the top plunger projecting into the cavity sufficiently for guided movement thereinto.

Upon the application of ram pressure to the plungers, the plunger support pins, which are somewhat weaker than the die support pins, break under pressure to permit the upper plunger to move downwardly to sequentially close the outgassing ports and engage the top surface of the powder material. As ram pressure is further increased, the lower plunger which is held in place externally of the vacuum system to prevent it from applying atmospheric pressure to the lower plunger, is released and allowed to move freely. The increased ram pressure on the upper plunger is transmitted through the powder material (now in a fluidized or plastic state) to the lower plunger and ram. Finally, the lower ram makes contact and the powder material is compacted. Under the application of ram pressure, the die support pins break and the die body converts from a rigid mode to a floating mode.

Further, as previously noted, it has been recognized that the vacuum hot press according to the invention creates a highly compact and strong structure. This characteristic can be employed to establish a strong intimate interconnection or junction between the compact body and a graphite and/or carbon element. For example, a strong joint between a graphite or carbon element and a non-carbide forming metal or alloy is particularly useful in various high temperature heating systems, such as, elements for resistance heating furnaces as well as for arcing electrodes for welding, lighting and the like. Sliding electrical conductors, such as brushes in an electric motor, may advantageously be constructed of or with a graphite surface to obtain good lubricating properties associated with graphite.

Such devices are presently created with threaded or other mechanical interconnections such as, clamping, bolting, interference fits or the like. Alternatively, where the metal is appropriate, a carbide formation at the interface may create a strong physical bond. An interfacing layer which will alloy with the metal and form a carbide interface with the graphite carbon may be employed. For example, zirconium will form a carbide to bond to the graphite and form an alloy with copper to form a firm bond.

Carbide joints or connections are intimate, atomically created, and therefore highly desirable joints for carrying high magnitude currents. However, even though atomically created, the carbide joint is generally quite brittle and is limited to metals and metal alloys which form suitable stable carbides with graphite or carbon. The last-mentioned characteristics of the joints generally reduce electrical and thermal conductivity, which may introduce some limitation in the use of the composite structure.

In accordance with this aspect of the present invention, graphite or carbon elements may be uniquely bonded to a powdered metal compact body by hot vacuum pressing of the powdered compact body onto the porous graphite or carbon element. It has been found that the powdered material fills and is locked or bonded into the pores of the porous element with a resulting firm physical attachment of the metal compact body to the porous element.

In accordance with still a further feature of this invention, in the event a firm, physical bond of the type described is not desirable, a weak interface or joint may be formed by interposing a release layer of powdered graphite or carbon between the porous element and the compact body. The powdered graphite or carbon is compacted during the vacuum hot pressing but will not firmly bond to itself because of the relatively low temperatures and pressures employed in the process.

The same apparatus and procedures may be employed to form composites of powder compact bodies intimately locked or bonded to a porous element of graphite, carbon or the like with a direct firm attachment or with an interposed, antibonding layer to control the degree of attachment. For example, the vacuum hot pressing plunger may be formed of graphite, which is for practical reasons a relatively porous member. The final compact body is then specially removed in a separate, additional manufacturing step. Further, certain hot pressed metal or alloy powders form carbides which may form a strong bond to non-porous graphite. In this aspect of the invention, a thin anti-bonding layer of carbon or graphite particles or any other material, such as, special papers or the like which will decompose to form carbon during the operation of the vacuum hot press apparatus, may be employed. The loose carbon prevents the metal powder material from entering into the porous element or reacting with a non-porous element to form carbides and thereby effectively prevents creation of a strong bond or joint. The strength of the weakened joint may be selected by controlling the quantity of the anti-bonding layer.

The present invention thus provides a new method and apparatus for forming compact bodies from particulate material and more specifically compact bodies for use as high-current interrupter contacts for vacuum interrupters, plasma devices and the like, which contacts can be economically produced while controlling the properties thereof.

BRIEF DESCRIPTION OF THE DRAWINGS

The drawings furnished herewith illustrate preferred embodiments of the present invention in which the above advantages and features are clearly disclosed as well as others which will be readily understood from the following description.

In the drawings.

BRIEF DESCRIPTION OF THE PREFERRED EMBODIMENTS

Figure 1:
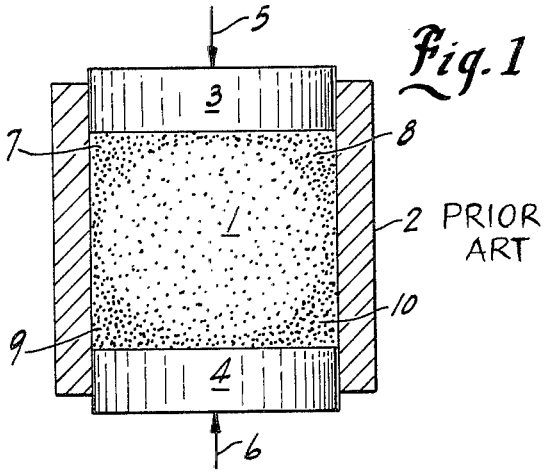
FIG. 1 is a side elevation view of a contact compact body being formed in accordance with a prior art method.

Referring now to the drawings in greater detail, and more particularly to FIG. 1, a prior art method of manufacturing vacuum contact compact bodies over which the methods of this invention are an improvement, will be described. A mixture of metallic powder material 1 of which the contact, compact body is to be formed, is placed within a die cavity 2 between the base of an upper plunger 3 and a lower plunger 4. Gases may be partially removed from the powder material 1 by subjecting them to a vacuum prior to the application of pressure thereto. Consolidation of the powder material 1 is brought about by application of pressure to the plungers 3 and 4 as indicated by the arrows 5 and 6.

While to a greater or lesser extent, all of the powder material 1 is compacted, the compaction is non-uniform as indicated by the relative density of the dots representing the compacted powder material. As shown by the density of the dots, the greatest compaction, i.e., higher density of the powder material, occurs at the plunger faces and die walls, and more particularly, at the corners thereof as indicated at the locations 7, 8, 9, and 10. The powder material is compacted in the die cavity, as shown in FIG. 1, at room temperature, and at relatively high pressure, on the order of 8000 kg. $cm^{-2}$. Typically, the compact body is removed from the die cavity and then placed in a sintering furnace and heated to an elevated temperature somewhat less than the melting point of the lowest melting point constituent of the compact body.

Figure 2:
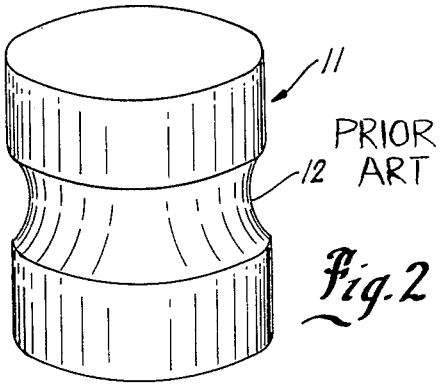
FIG. 2 is a perspective view of a contact compact body after sintering in accordance with the prior art method.

Following compaction and sintering, the shape of the contact compact body 11 is generally as shown in FIG. 2, including a central annular constriction as at 12. While to some extent the reduction of cross-section of the center of the contact as shown at 12 may be exaggerated, nevertheless, a distinct shrinkage occurs in this area due to the lower initial density of the powder material in this portion of the contact, compact body. Generally, such compact bodies, particularly in the central area, have appreciable residual porosity wherein gas is often entrapped. When a powder material is compacted at room temperature, work hardening of the compact body being formed is experienced such that densification is increasingly retarded and finally stopped. Further, friction between the outer surfaces of the compact body and the engaged die walls and die plunger working faces may further result in a non-uniform density distribution. The less desirable characteristic of such a contact compact body will be readily recognized by those skilled in the art as generally set forth previously with respect to the prior art.

Figure 3:
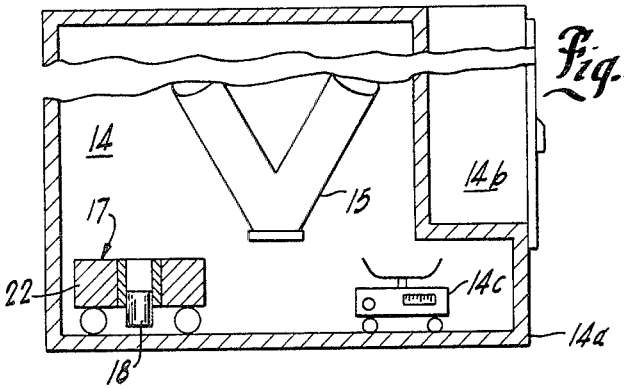
FIG. 3 is a view of a die assembly and material preparation and dispensing arrangement for forming a contact compact body in accordance with one embodiment of the invention.
Figure 5:
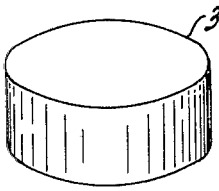
FIG. 5 is a view of a final contact compact body fabricated in accordance with the method of the present invention.
Figure 4:
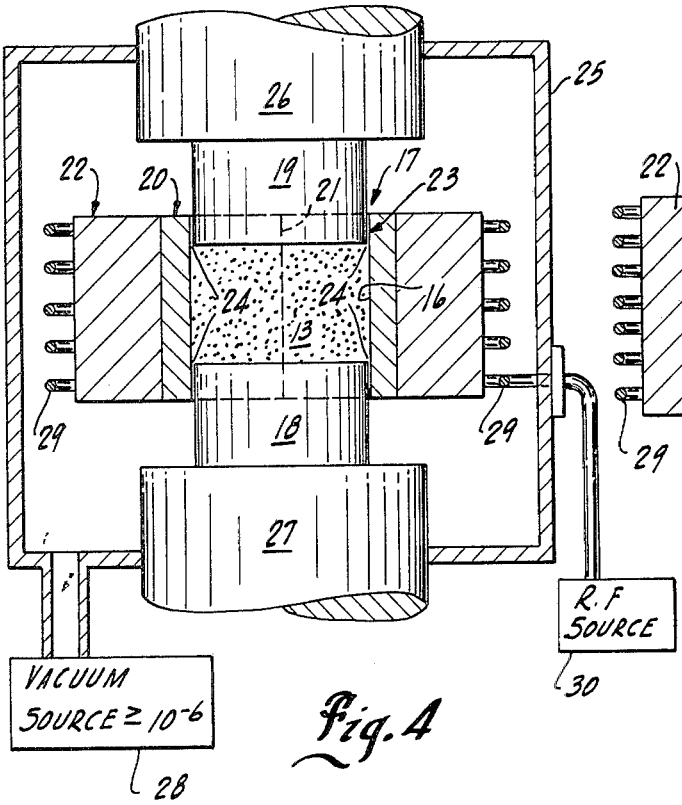
FIG. 4 is a sectional view of a contact compact body being formed in accordance with the method of the present invention.

Making reference to FIGS. 3–5, one method of forming a contact compact body in accordance with this invention is described. The following method is followed for making a contact, compact body:

Step I

Supplies of high purity, small particle-sized powder material of the desired composition of substances or materials are retained in an inert environment, such as argon 14, within a gloved housing 14*a* having an interlock entrance chamber 14*b*. Although other gases such as nitrogen might be employed, the complete inertness of argon makes the latter more suitable. The particle size is not critical, but is preferably a nonuniformly sized particle powder material to enhance particle-to-particle bonding and packing. As a practical example, copper (Cu) and zirconium diboride ($ZrB_2$) are selected as components suitable for forming a compact body for use as a contact in a vacuum interrupter, plasma device or the like. The powders are both typically of a −325 mesh.

Step II

While maintaining the powder material in the inert environment, the desired quantities of the separate powders comprising the powder material are weighed in a suitable scale unit 14*c* to obtain the desired composition. Copper is generally the major component with the zirconium diboride constituting typically 0–2% by weight, although it may be as much as 75% of the contact composition. The powders are placed in a mixer such as a stainless V-blender 15, for a predetermined period of time to ensure complete mixing and to prevent segregation due to density differences and to avoid agglomerate formation. The powders are held in sealed containers and mixing may be done in a suitable sealed, gloved housing 14*a* having suitable viewing windows.

Step III

Referring now specifically to the die cavity of FIG. 4, the blended powder material prepared in Step II is placed into die cavity 16, shaped to form a contact button, and formed by a plunger and die assembly 17 within the gloved housing to maintain the protective environment about the powder material. Generally, the illustrated plunger and die assembly 17 includes a lower plunger 18 and an upper plunger 19, both of which are telescopically received within the opposite ends of the bore of a split die insert 20 which is, in turn, received within a die body 22. The split die insert 20 is formed of a pair of identical semicircular segments with a central dividing plane 21. Insert 20 can be readily slipped from body 22 without damage to the body. This permits convenient and practical separation of the compact body from the die assembly as hereinafter discussed. The lower plunger 18 is located within the bore of the die insert 20 to define open top cavity 16 for receiving the blended powder material 13. Gentle tapping of the die cavity body 22 provides some compacting of the powder material 13 so as to provide a maximum sized compact body. The tapping should not be excessive since density segregation may occur. The die cavity 16 is sized such that some empty space 23 is allowed at the top of the die cavity so that the upper plunger 19 may be guided into the die insert 20. With the upper plunger 19 in place, the powder material is essentially protected from reactive atmospheres (such as when moving the filled assembly 17 to the vacuum hot press chamber) due to the limited clearance 24 (shown substantially enlarged) between the plungers and die insert 20. The die assembly 17 including powder material 13 therein may thus be transferred to the vacuum system and chamber 25. For effectively sealing the die cavity to protect the powder material from reactive atmospheres, such clearance 24 should not generally exceed 0.025 millimeters. The "slide spacing" 24 between the plunger and die must, however, be sufficiently large to allow the powder material to be outgassed under vacuum over a practical time period, typically one hour. It has been found that the diameter of the bore of insert 20 must generally be at least 0.010 mm. greater than the diameter of the plungers 18 and 19.

Step IV

In the embodiment of FIG. 4, the vacuum chamber 25 is provided with vertically movable rams 26 and 27 which project from the chamber 25. After the die assembly 17 has been positioned in the vacuum chamber, the rams 26 and 27 are moved to just engage the plungers 18 and 19. A vacuum of approximately $3\times10^{-6}$ torr is then created within the chamber 25. Essentially only atmospheric pressure is applied to the rams 26 and 27. No other forces are applied to the plungers 18 and 19 at this time. The chamber 25 is connected to a suitable pump 28, i.e., a mechanical or oil diffusion pump, capable of creating and maintaining a pressure on the order of $3\times10^{-6}$ torr or lower. The vacuum created in the chamber 25 serves to withdraw gases from the blended powder material. With only slight pressure on the rams 26 and 27, the powder material 13 remains sufficiently loose thereby to ensure that gases are not trapped between the powder particles, and yet, the powder material begins to become compacted and takes on the geometry of the final contact, i.e., the geometry of the die cavity. The application of ram pressure at this point would normally result in gassier compact bodies. This could have detrimental effects if the compact bodies were to be used as contacts in vacuum current interrupters, plasma devices and the like.

Step V

In a preferred embodiment of this invention, the die body 22, die insert 20 and plungers 18 and 19 are preferably formed of graphite, which has high thermal shock resistance, good strength at high temperatures, and a low vapor pressure. Such material is also a natural reducing agent. With the vacuum chamber 25 at a sufficiently low pressure, the die assembly 17 and the powder material 13 are slowly heated by radio frequency induction from a suitable R. F. source 30 connected to coil 29 which is mounted within chamber 25 encircling the die body 22. While the temperature of the die assembly 17 and powder material 13 is being increased, the pressure in the chamber 25 is not permitted to rise above $1\times10^{-5}$ torr and is preferably held in the range of $10^{-6}$ torr or lower. This will minimize the extent of oxidation and/or other particle-atmosphere reactions within the bulk of the powder material 13. The temperature is increased steadily until it is almost at the melting point of the lowest melting point component. For example, in the illustrated embodiment, copper has the lowest melting point of 1083° C. and the assembly may be heated to within about 5° C. thereof or preferably between 1075° and 1080° C. While lower temperatures might be used, gassier and less dense compact bodies would result.

Step VI

After the vacuum chamber pressure has reached approximately $3\times10^{-6}$ torr, or lower, additional pressure is applied to the rams 26 and 27. In an optimum mode, the pressure is increased in relatively small increments followed by frequent pressure releases which aid in a more thorough outgassing of the powder material 13. The maximum ram pressure which may be employed is limited by die strength. However, in accordance with this method, a maximum pressure of approximately 400 kg. $cm^{-2}$, has been found to be completely adequate, and is much less than would be required in standard powder-metallurgical techniques. For instance, cold compaction as discussed above usually requires 8,000 kg. $cm^{-2}$.

Step VII

Maximum plunger pressure and maximum temperature are maintained on the powder material 13 for a relatively short time, approximately, one hour. It has been observed that 99% densification occurs within the first hour. In standard sintering with no external pressure applied, the higher maximum ram pressure and, subsequently, the maximum temperature may have to be maintained for 100 to 1,000 hours in order to achieve anything approaching 100% theoretical densities, i.e., zero porosity.

A strong indication that sufficient heat and pressure have been applied is the observation of linear expansion resulting from the various vacuum hot press assembly parts slowly expanding in response to the temperature. This may be detected as an increase in ram pressure without having increased the ram pressure by other external means.

Pressure may be applied to the upper ram 26 with the lower ram 27 supported on any suitable means. However, the die plungers or rams 26 and 27 are both movable relative to the die body 22 to form a floating die. This contributes to a uniform density within the final compact body. Thus, the system functions as a double ram action press to distribute equally the forces on the powder material 13 during the process.

Step VIII

Thereafter the die assembly is allowed to cool to room temperature while maintaining approximately 400 kg. $cm^{-2}$ on the powder material 13. During this period, argon may be introduced into the chamber to provide a more rapid cooling of the die assembly.

Step IX

Finally, the die assembly 17 is removed from the vacuum chamber 25 and the compact body is freed from the faces of the plungers 18 and 19 and the die insert 20. The graphite plungers 18 and 19 will often have some porosity or form a carbide with the metal powder, either of which may create a partial bond between the compact body, the plungers and the insert. The compact body may, however, be readily cut from the plungers. The resulting compact body is typically a solid cylinder 31 as shown in FIG. 5. Clean-up machining may be necessary after which the compact body may be sliced or cut into smaller pieces to produce electrical contacts of the required size.

In disassembly, the die insert 20 may be readily removed from body 22 and the two segments separated from the resulting compact body by pulling them apart. This minimizes the stress applied to the compact body. The die insert 20 is removed with the plungers intact. The use of the insert 20 also minimizes die maintenance expense.

The powder particles may be of any suitable material, including a high conductivity material in combination with a dissimilar material to provide other desired characteristics. The powders comprising the powder material may advantageously include at least one component selected from the group consisting of copper, silver, gold, aluminum, beryllium, magnesium, calcium, nickel, indium, rhodium, cobalt, iridium, and zinc; and a second from the group consisting of copper, silver, gold, aluminum, beryllium magnesium, calcium, strontium, barium, scandium, zinc, yttrium, lanthanum, titanium, zirconium, hafnium, vanadium, indium, niobium, tantalum, chromium, molybdenum, tungsten, manganese, technetium, rhenium, iron, ruthenium, osmium, cobalt, rhodium, iridium, nickel, palladium, platinum, boron, carbon, silicon, germanium, the actinides, and the lanthanides. The second material may also be a compound of one of the materials, selected from the group consisting of a boride, phosphide, oxide, nitride, silicide, carbide, halide, arsenide, selenide, telluride, antimonide, or sulfide.

Figure 7:
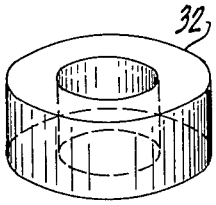
FIG. 7 is a view of a contact compact body formed with the apparatus of FIG. 6.

The process or method of the invention may also advantageously be applied to the formation of other shaped contacts, such as, for example, the annular or doughnut shaped contact 32, shown in FIG. 7. An apparatus particularly adapted for forming an annular contact 32 is shown in FIG. 6, wherein elements corresponding to those of the embodiment of FIG. 4 are similarly numbered and identified for simplicity and clarity of explanation.

Figure 6:
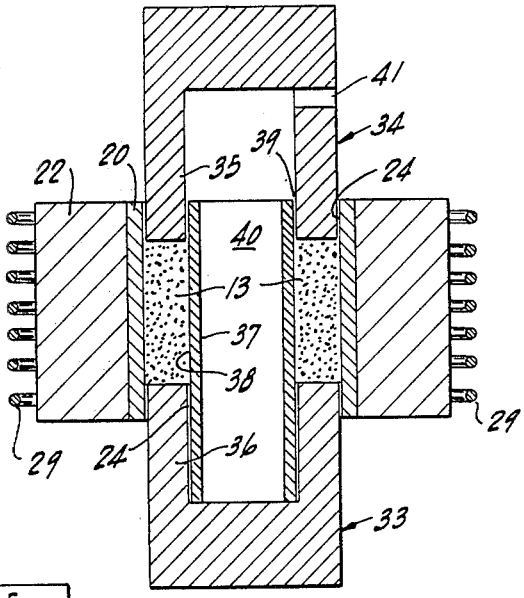
FIG. 6 is a sectional view of an apparatus for forming an annular shaped contact compact body in accordance with the method of the present invention.

To form the annular contact 32, the die assembly 17 is generally formed as in the embodiment of FIG. 6. Generally cup-shaped plungers 33 and 34 are employed and mounted opening toward each other within the die cavity body 22. The inner and outer diameters of the encircling walls 35 and 36 formed by the plungers correspond to the radial thickness of the final compact 32. An inner die insert 37 is located within the outer die insert 20 of the cavity body 22 to define an annular chamber or cavity 38 into which the annular plunger walls 35 and 36 project. The inner die insert 37 is shown projecting into and being supported by bottom plunger 33. Die insert 37 projects upwardly from the compression end of bottom plunger 33 to define an annular cavity 38 in which the powder material 13 is received. The upper plunger 34 projects downwardly into annular cavity 38. The cup-shaped configuration of upper plunger 34 permits relative collapsing movement of the two plungers 33 and 34, with the inner die insert moving into cup-shaped member 34.

The cup-shaped plungers are formed with suitable close clearance 24 between exterior walls of the plunger and the outer die insert, and with a similar suitable close clearance 39 between the inner die insert 37 and the inner wall of the the cup-shaped plungers 33 and 34. As in the previous embodiment, clearances 24 and 39 are kept sufficiently small to protect the powder material 13 in the cavity from reactive atmospheres, at least during the period that the die assembly 17 is transferred into the vacuum chamber. The clearances are, however, sufficiently large to permit outward movement of the gases from the finely divided powder material 13 between plungers 33 and 34 and die inserts 20 and 37, respectively. To prevent gases from being trapped within inner chamber 40, upper plunger 34 is formed with an outgas opening 41 for venting any gases from the inner chamber 40, particularly under a vacuum condition.

The steps of forming the vacuum hot press metal compact 32 from the powder material 13 to form an essentially finished annular contact is otherwise the same as previously described with respect to FIG. 4 and, consequently, no further description thereof is given herein.

As discussed heretofore, a very important step in the formation of high quality compact bodies for use as contacts which are to be subjected to high current arcs involves removal of the trapped gases from within the contact body. Although clearances 24, 39 provided between the compression plungers and the cavity wall of the die assembly embodiments of FIGS. 4 and 6 permit outgassing, during the compacting process, such clearances may be inadequate as outgassing ports because of the extremely low conductance of the flow paths independent of the capacity of vacuum pumping means 28. In addition, support of the floating die assemblies, as shown in the embodiments of FIGS. 4 and 6 may also be inadequate. The thermal expansion of the different die parts may be such that the clearance increases and allows the die body to drop down. Further, the system is not particularly well suited to handle large die bodies where the weight is such as to tend to cause movement and separation of the die parts.

Figure 8:
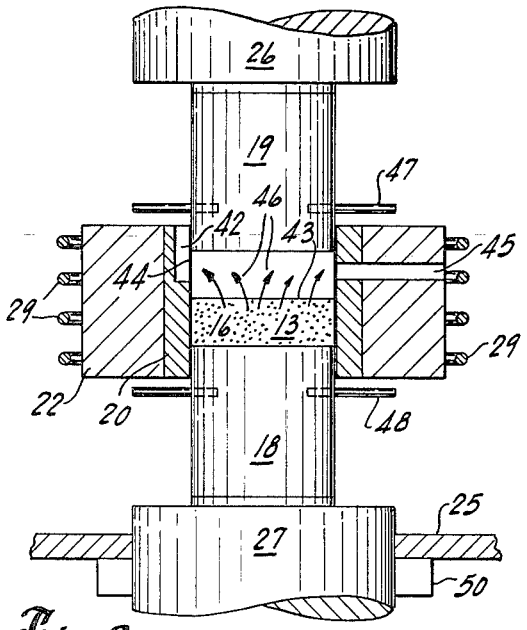
FIG. 8 is a sectional view of still another embodiment of a die assembly employed in accordance with the present invention.

An improved embodiment of the invention including a special outgassing means which minimizes the aforementioned difficulties while maintaining an effective floating die module with double ended pressing is illustrated in FIG. 8.

Generally, the embodiment of FIG. 8 is similar to that illustrated in FIGS. 4 and 6. Again, corresponding elements are identified by corresponding numbers for simplicity and clarity of explanation. The modified embodiment of the structure in accordance with this aspect of the present invention is described as follows.

In FIG. 8, the die body 22 is formed with the insert 20 as in FIG. 4 to protect the basic portion of the die body and for ease of separation and removal of the die body and for ease of separation and removal of the compact. In the embodiment of FIG. 8, however, the insert 20 is formed with an inner surface port or passageway 42 which extends from the top edge of the insert 20 downwardly into the area of the forming cavity 16. The passageway terminates above the uppermost level 43 of the fluidized powder material 13 introduced into the cavity 16 for subsequent hot pressing. The top plunger 19 projects into the top end of cavity 16 and thus defines a radial port 44 extending outwardly via port 42 from cavity 16.

In addition, in the embodiment of FIG. 8, a radial port 45 is included which extends radially from the cavity 16 through insert 20 and die body 22. Port 45 is placed at a location similar to that of port 44 of the passageway and merely illustrates an alternative construction for directing the gases from the cavity. The released gas indicated by arrows 46 may, therefore, move readily from within the cavity in the presence of the vacuum. At all times, the uppermost surface 43 of powder material 13 is located below the outgassing ports 44 and 45 in order to positively prevent extrusion of the material through such ports, particularly as the chamber pressure is decreased and the ram oscillated to withdraw the gases.

Any other form of port may, of course, also be employed in accordance with the teachings of the present invention. The only requirement is the provision of a separate and distinct outgassing passageway which communicates with the cavity above the uppermost level 43 of the noncompacted powder material, for direct discharge of gases 46 from the cavity 16 while avoiding extrusion of the powder material 13. Obviously, top plunger 19 could be completely removed for outgassing in any of the illustrated embodiments. However this would require relatively exact guide means disposed within vacuum chamber 25 for insertion of plunger 19 into die body 22. Although this can be accomplished with clearances which are, as previously noted, less than 0.025 mm, such structure would be less desirable in practical commercial production.

Further, the illustrated embodiment of FIG. 8 includes a means to support the die assembly in a rigid die mode until pressing is initiated and to then change to a floating die mode, as follows.

The upper plunger 19 is provided with a plurality of supporting pins 47 extending radially from the plunger, in outwardly spaced relation to the inner operating or working face. The pins 47 rest on the upper surface of die body 22 and are located to positively hold plunger 19 with the inner face of the plunger within the die cavity in the desired spaced relation to the outgassing ports 44 and 45. Even though the plunger 19 projects into cavity 16 only slightly, pins 47 support the plunger sufficiently well to avoid a need for a guide or other special means when pressing the power material.

Lower plunger 18 is also provided with one or more supporting pins 48 in outwardly spaced relation to the working face of the plunger. The pins 48 project radially outwardly beneath die body 22 and form a support for the die body including the die insert.

Pins 47, 48 extending from the two opposed plungers 18 and 19, respectively, prevent undesired separation or movement of the die parts as a result of thermal expansion or their weight and permit convenient movement thereof into the vacuum chamber.

In the embodiment of the invention shown in FIG. 8, as in the previous embodiments, the die cavity is filled with the appropriate mixture of powder material 13. The powder material remains below the outgassing ports 44 and 45 with the lower plunger 18 projecting into the cavity and supporting the die body. The upper plunger 19 is thereafter introduced into the upper end of the cavity with the supporting pins 47 resting on die body 22 to locate the compressing working face of the plunger 19 in proper relation to powder material 13. The system is then placed into a suitable vacuum chamber 25. A vacuum is created to outgas the powder material and then heated as in the case of the previous embodiments.

After a period of time, ram pressure is applied only to the upper plunger 19 which is connected to a suitable single hydraulic or pneumatic operator. The lower plunger 18 is supported by a releasable latch means 50 to prevent application of atmospheric force on the plunger. The increasing force applied to plunger 19 will reach a level sufficient to break the upper supporting pins 47, after which the plunger 19 moves into the die cavity, first moving past the outgassing ports 44 and 45, and then moving the working face into contact with the fluidized powder material 13. At this point, latch means 50 is released and the lower plunger 18, which has been held in place by the latch means to prevent application of atmospheric pressure on the plunger, is released and allowed to move freely. The increasing pressure on the upper plunger 19 is transmitted to the lower plunger and ram through the fluidized powder material. Lower ram 27 makes contact with a rigid surface, and movement of the upper plunger 19 continues to effect the vacuum hot pressing of the powder 13, as previously discussed. Lower pins 48 are also breakable but are capable of withstanding a greater force than the upper pins. When lower pins 48 have broken, the die assembly changes to a floating die.

During the final compaction, closing of the outgassing ports 44 and 45 decreases the efficiency of additional outgassing. Multiple plunger pressure applications and releases, as heretofore discussed, are employed to aid in the final outgassing of the compact body. Completion of the hot pressing may be detected in the same manner as previously discussed; i.e., expansion of the plunger without any change in applied ram pressure conditions.

The embodiment of the invention shown in FIG. 8 also employs a single action press apparatus with a floating die mode of operation to produce the result normally requiring multiple action presses. Further, neither springs nor other auxiliary devices are required in the illustrated embodiment of the invention. Resilient supports may, however, be employed within the broadest aspect of this invention. For example, the die body could be supported by springs.

Figure 9:
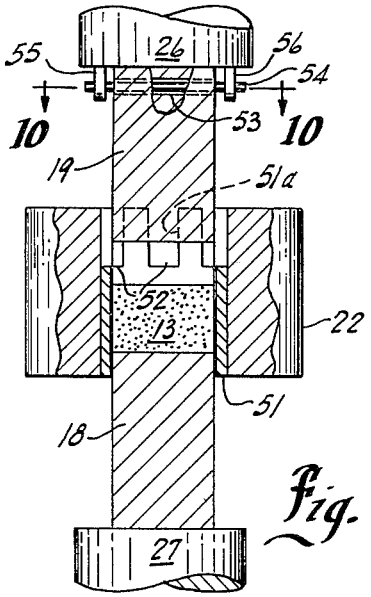
FIG. 9 is a sectional view of still another embodiment of a die assembly employed in accordance with the present invention for forming a cylindrical contact compact body.
Figure 11A:
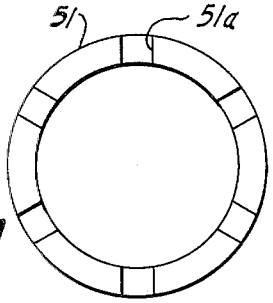
FIGS. 11*a* and 11*b* are top and side elevational views respectively, of a split die insert included in the die assembly of FIG. 9.
Figure 11B:
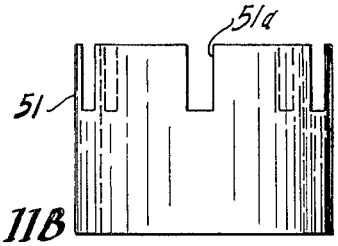

An alternative die body structure insert to provide outgassing ports as well as to support the top plunger 19, is shown in FIG. 9. In the embodiment of FIG. 9, a die insert 51 (See FIGS. 11A & 11B) is formed with a castellated upper body portion defining a plurality of inwardly projecting notches 51*a* extending from the uppermost edge predeterminedly downwardly. The upper plunger 19 is introduced into the upper end of the cavity. The upper ends of notches 51*a* are closed by the plunger while the lower ends communicate with the cavity to define, with the adjacent insert, ports 52. Once again, the length of the notches 51*a* is that the uppermost surface of loose powder material 13 is significantly below the lower edge of the parts.

Figure 10:
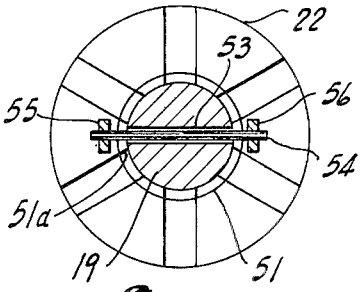
FIG. 10 is a sectional view taken along line 10—10 of FIG. 9.

In the embodiment of FIG. 9, an alternate support for the upper plunger 19 is also shown which permits complete withdrawal of the plunger, if desired. More particularly, referring to FIGS. 9 and 10, the uppermost end of the plunger 19 includes a transverse opening 53. A supporting die pin 54 extends through the opening 53 and into a pair of support arms 55 and 56 extending downwardly from movable ram 26 to the opposite sides of plunger 19. In operation, when ram 26 is moved inwardly, pressure is first applied through coupling pin 54 to the die plunger 19, which then moves downwardly to sequentially close outgassing ports 52 and engage the upper surface of plastic powder material 13. In the illustrated embodiment of the invention, lower plunger 18 rests on bottom ram 27. As the pressure increases, pin 54 breaks, allowing ram 26 to move downwardly into direct pressure engagement with plunger 19 for establishing the desired high pressure on the hot plastic powder material 13. In this method, ram 26 could be raised to completely remove the upper plunger 19 for outgassing of the powder material. As previously noted, though, this would require accurate guiding of the plunger back into the cavity. Alternate means of disconnecting plunger 19 from ram 26 may be used to eliminate the necessity of fracturing pin 54.

Figure 12A:
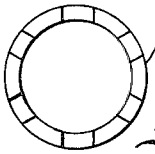
FIGS. 12*a* and 12*b* are top and side elevational views, respectively of a castellated inner die body usable in the die assembly of FIG. 9 to make an annular contact.
Figure 12B:
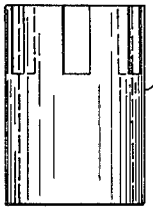

The embodiment of FIG. 9 can be also used for forming an annular or doughnut shaped contact. The latter, is accomplished as in the case of the embodiment of the die assembly of FIG. 6, except that an inner insert 57, as shown in FIGS. 12*a* and 12*b*, is formed with an appropriate castellated upper end and is employed in the embodiment of FIG. 9, and used with outer insert 51 of FIG. 9 and the pair of cup-shaped plungers 33 and 34 of FIG. 6. The operation of the device as modified to form annular or doughnut shaped contacts will be apparent to those having ordinary skill in the art and therefore no further description thereof will be given herein.

The present invention may also be employed to form a unique oxygen/copper contact in which oxygen in excess of 2 ppm by weight is present in forms other than as free oxygen gas and generally in the form of either cuprous and/or cupric oxide. To accomplish the latter, copper particles or powders which may include relatively large quantities of oxygen are used to form the compact body. Such copper powder which is generally argon prepared and packed in accordance with general commercial practice, has been employed. The powder has a nominal −325 mesh. The vacuum hot press process results in the formation of an electrode having a theoretical density greater than 98% and which is machinable by conventional techniques. Satisfactory contacts have been constructed with 270 ppm of oxygen. The oxygen content could obviously be greater. The oxygen content may even be as much as 3% by weight of the contact but this would appear to be a practical upper limit. A contact so formed has shown an ability to interrupt 12,000 amperes at rated voltage on open-instantaneous-close-open operations (typical of 15 kV, 300 MVA test duty). The impulse level was equal to or better than commercially available bismuth/copper contacts, as were the apparent erosion rates. The chopping level similarly appears to be equal to or less than bismuth/copper contacts regardless of arc location on the contact or electrode. The new contact has excellent conductivity, generally 80% or better IACS.

Vacuum hot pressed copper contacts may be formed having an integral back and raised ring or button. They are also sufficiently malleable to permit direct roll forming of the electrode edge to the support cone as an alternate method of attachment to that as shown in U.S. Pat. No. 3,591,743 assigned to the same assignee as the subject application. Thus, the compact formed as a single integral contact button and contact back avoids the necessity of recrystallized copper backs and the conventional brazed joint between the button or ring and separate back. The high oxygen content in the contact contributes to anti-welding of the contacts, while maintaining acceptable running and extinguishing of the arc.

It has been discovered that oxygen in power interrupter contacts in compound form can be tolerated to much higher levels than was thought possible heretofore. Furthermore, highly satisfactory contacts may be obtained with high oxygen content without the necessity of using special high purity copper and other special oxygen minimizing processes and techniques. Although the oxygen contact may include only copper, it may also be formed of a plurality of other materials, such as the above described zirconium/copper diboride contact.

The process of the present invention thus can be employed to provide a high oxygen content contact which, contrary to the usual teaching, is not only suitable for interruption of power system currents and the like, but exhibits other characteristics desirable in electrical contacts.

Figure 13:
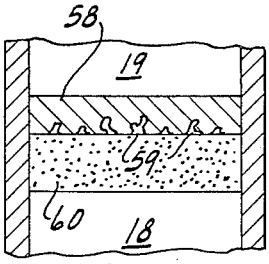
FIG. 13 is an enlarged, fragmentary, sectional view of a portion of a composite element being formed in accordance with a variation of the method of the present invention.

In accordance with a further teaching of the present invention, a strong atomically intimate bond of a high conductivity metal or metal alloy to a graphite or carbon element may be created by the vacuum hot pressing method. As previously discussed, a carbon or graphite element may be readily formed with a porosity in excess of five percent. Such an element 58 is shown in FIG. 13. The element includes a plurality of surface recesses or pores 59 within which metal powder material 60 can be pressed through the hot vacuum press process according to the invention. The resulting compact body has the pressed metal or metal alloy locked or bonded in place and in atomically intimate contact with the powder material. FIG. 13 illustrates the interface between the solid graphite element 58 of limited but significant porosity and a hot pressed metal or metal powder material 60 alloy. The sites or pores are, of course, shown substantially enlarged. Although a molten metal or metal alloy cannot generally be bonded to graphite, the very finely divided metal powder material suitable for vacuum hot pressing readily fills such pores. For example, if the plungers 18 and 19 of the previous embodiment of FIG. 4 were of relatively high porosity; i.e. greater than 5%, the metal compact would tend to be joined to the graphite plungers with an atomically intimate and strong joint, thereby to provide electrical and thermal conductivity at the interface.

Where a strong joint is desired, significantly greater ram pressure than that heretofore described is employed. For example, maximum ram pressure may approach approximately 10,000 kg. $cm^{-2}$ during which the maximum temperature applied is below the melting temperature of the metal or metal alloy. As was previously described, the application of high ram pressure and temperature is continued for a relatively short time, on the order of one hour or less. The final processing is similar to that previously discussed wherein the assembly is allowed to cool naturally and set to form a composite graphite-metal element.

Figure 14:
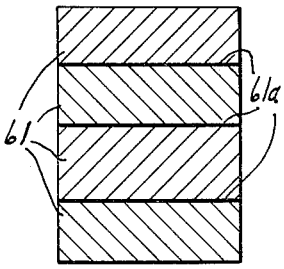
FIG. 14 is a side elevational view of a multiple part element formed in the same manner as the composite element of FIG. 13.
Figure 15:
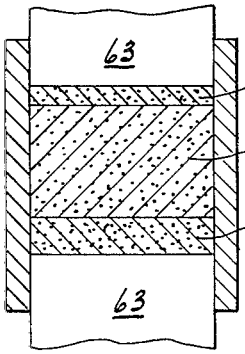
FIG. 15 is a fragmentary view, similar to FIG. 14 illustrating the formation of a composite element having a weak junction.

If two graphite or carbon elements are to be bonded to each other, a relatively thin non-carbide forming metal or alloy layer is introduced between the two elements. Similarly, other composite layered elements can be readily formed, for example, by placing high conductivity non-carbide forming metals or alloys 61 on the opposite sides of the carbon or graphite 61*a* layer, having a porosity in excess of 5%, for example, as shown in FIG. 14. Generally, the method is not restricted by the size or thickness of the several elements or the depth of the interfaces. Further, any number of elements can be joined in one operation as a simple extension of the technique of stacking parts for a multilayered effect.

Where a bond is not desired and the graphite layer has a porosity in excess of 5% and/or the metal or metal powders form a carbide, suitable means, such as, for example, an anti-bonding agent or material, must be provided to prevent an atomically intimate high strength joint. Such anti-bonding agent and its placement is illustrated in FIG. 15. As can be seen in the last-mentioned figure, an anti-bonding layer 62 of a relatively loose carbon or graphite powder is introduced between the porous element 63 and the metal powder 64. Generally, vacuum hot pressing according to the present invention, for compacting metal or metal alloys, particularly for electrical contacts and the like, is achieved at a temperature below 2,000° C. and with ram pressures less than $10^5$ kg. $cm^{-2}$. Carbon or graphite does not bond to itself under such vacuum hot press conditions. The anti-bonding loose carbon 62 is thus located between the porous surface of the graphite plunger and the powdered metal to effectively prevent the intimate bonding of the metal or alloy powder to the graphite plunger. If the metal or metal alloy is of a type which forms a carbide and tends to create a firm bond, such carbide formation occurs only within the "loose" carbon layer 62 so long as the layer is of sufficient thickness. Generally, a layer thickness equal to or greater than 0.01 mm is sufficient to prevent carbide bonding as well as the forming of an atomically intimate mechanical junction between the graphite element and metal powder.

Although loose carbon or graphite powder is recommended, any other suitable material, which under the vacuum hot press forming conditions produces a carbon interface, may be used. Special tissue papers or other pure cellulose papers are examples of such materials which readily decompose into carbon during the vacuum hot press operation.

Further, where a joint exhibiting a specific strength is desired, the degree of bonding may be controlled by selection of the thickness of the anti-bonding layer, or otherwise controlling the quantity of the anti-bonding layer between the surfaces of the graphite element and the metal and/or metal alloy.

Thus, the present invention is directed to an improved method for vacuum hot pressing selected powder material for forming compact bodies useful as electrical contacts in vacuum current interrupters, other plasma devices and the like, where relatively high current arcing conditions are encountered at the contact surface, particularly where the composition of the contact includes a plurality of different metals or constituents.

We claim:

1. The method of forming a compact body of powdered material comprising the steps of at least partially filling a die cavity with powdered material, while retaining said die cavity in a protective inert atmosphere, locating the die cavity including the powdered material within a vacuum chamber, forming a predetermined vacuum in said chamber sufficiently high to remove essentially all free gases from within said powdered material, slowly heating the die cavity and powdered material to less than the melting temperature of the powdered material, to a sintering temperature, and closing the die cavity to incrementally compress the powdered material, while maintaining said predetermined vacuum and said sintering temperature, thereby to form said compact body.

2. The method of claim 1 wherein the powdered material is conductive.

3. The method of claim 1 further including the step of selecting powdered material which is initially non-conductive and which becomes conductive during compression thereof in said vacuum at said sintering temperature to form a conductive compact body.

4. The method of claim 1 further including the step of thoroughly mixing a plurality of powder components having different characteristics to form said powdered material, introducing said powdered material into the die cavity while maintaining the powdered material in said protective inert atmosphere, and heating said die cavity and said powdered material to a temperature less than the melting temperature of the powder component having the lowest melting temperature.

5. The method of forming a compact body of powdered material comprising the steps of at least partially filling the die cavity with powdered material retained in a protective inert atmosphere, locating the die cavity including the powdered material, within a vacuum chamber, forming a vacuum in said chamber to remove essentially all free gases from within said powdered material, slowly heating the die cavity and powdered material to less than the melting temperature of the powdered material, to a sintering temperature, and alternately increasing and decreasing the pressure in the die cavity to create a pulsating pressure application to said powdered material, while maintaining said vacuum and said sintering temperature, thereby to form said compact body.

6. The method of claim 5 including the further step of establishing and holding a final forming pressure in said die cavity.

7. The method of claim 1 wherein said die cavity includes a tubular wall including a plurality of separable segments, and further including the steps of removing the wall with the compact body and pulling said segments outwardly from said compact body.

8. The method of claim 1 wherein said powdered material includes copper particles and anti-welding particles, and wherein said powdered material is compressed at a pressure on the order of 400 kg. $cm^{-2}$ within a vacuum on the order of $3\times10^{-6}$ torr.

9. The method of claim 8 wherein said copper particles and the anti-welding particles are non-reactive, and further including the step of mixing said copper and anti-welding particles to form said powdered material.

10. The method of claim 8 wherein the copper particles and the anti-welding particles are reactive and form alloys as the result of the application of said temperature and pressures.

11. The method of claim 1 including forming the die cavity with a removal element having a porous surface, and pressurizing the die cavity to a pressure on the order of 10,000 kg. $cm^{-2}$ thereby to intimately join the compact body to said removable element.

12. The method of forming a multiple component compact body including the steps of;

providing a die cavity including a tubular body with opposed plungers forming the ends of the cavity, thoroughly mixing the individual powders in an inert atmosphere to form a powder mixture, removing one plunger within said inert atmosphere, introducing said powder mixture into said die cavity while maintaining said inert atmosphere, locating said die cavity in a vacuum, replacing the said one plunger to capture the powder mixture in said die cavity, moving at least one of said plungers inwardly and outwardly of said die cavity without complete removal thereof, thereby to increase and decrease, respectively, the pressure in said die cavity with increasing pressure levels for short periods to progressively compress the powder mixture, slowly heating the die cavity and powder mixture to less than the melting point of the powder component having the lowest melting point and establishing the final forming pressure and maintaining said pressure for a predetermined period substantially greater than the alternate pressure and release periods.

13. The method of claim 12 wherein said powder mixture comprises predominantly copper particles and a small amount of anti-welding particles for forming a vacuum interrupter contact, wherein said final pressure is approximately 400 kg. $cm^{-2}$ and said vacuum is approximately $3\times10^{-6}$ torr, and wherein said die cavity including said powder mixture is maintained at said final forming pressure in said vacuum for approximately one hour.

14. The method of claim 13 wherein said anti-welding particles are non-conductive and non-reactive with said copper particles.

15. The method of forming a multiple component compact body for use as a high current electrical arcing contact suitable for use in a vacuum interrupter, plasma device or the like comprising; thoroughly mixing a plurality of individual powders, each of said individual powders being suitable for use as a component of said contact, while retaining said powders in a protective inert atmosphere, placing the thoroughly mixed powders in a die cavity while maintaining said mix powders and the die cavity in said protective inert atmosphere, partially closing the die cavity to prevent free fluid movement of the mixed powders, locating the filled die cavity including the powdered material, within a vacuum chamber, forming a predetermined vacuum in said chamber without significantly closing the die cavity, said vacuum being sufficently high to remove gases from said mixed powders, slowly heating the die cavity and mixed powders to a temperature less than the melting temperature of the individual powders having the lowest melting temperature of the plurality of the mixed powders and at least to the sintering temperature of said mixed powders and closing the die cavity to incrementally compress the mixed powders, thereby to form said compact body.

16. The method of claim 15 wherein at least one of said mixed powders is metallic.

17. The method of claim 15 wherein at least one of said mixed powders is conductive.

18. The method of claim 15 wherein at least one of said mixed powders is non-conductive.

19. The method of claim 15 wherein at least one of said mixed powders is initially non-conductive and becomes conductive as a result of the forming process.

20. The method of claim 15 wherein at least one of said mixed powders is initially non-conductive and becomes conductive as a result of a reaction with another of the plurality of mixed powders during the forming process.

21. The method of claim 15 further including the step of creating a lesser vacuum in said chamber prior to heating and thereafter, increasing the vacuum in said chamber significantly to form said compact body.

22. The method of claim 15 further including the step of surface finishing said compact body to form said electrical contact.

23. The method of claim 15 further including the step of initially tapping said die cavity to provide slight initial compaction of said mixed powders.

24. The method of claim 15 wherein said vacuum is approximately $3\times10^{-6}$ torr for degassing said mixed powders.

25. The method of claim 15 further including the step of maintaining said temperature and pressure for a period of about one hour.

26. The method of claim 15 wherein the mixed powders include copper as the lowest melting point powder and said mixed powders are heated to a temperature of approximately 1080° C.

27. The method of claim 15 further including the steps of mixing said powders for a predetermined period to insure thorough mixing and to prevent segregation and formation of agglomerates, tapping the die cavity while placing said mixed powders therein to provide slight initial compaction, creating a vacuum of approximately $3\times10^{-6}$ torr while heating and compressing the mixed powders and maintaining said vacuum, temperature and forming pressure for a period of about one hour.

28. The method of claim 15 wherein said die cavity includes a central tubular body portion having upper and lower ends and a pair of plunger members telescoped into said body portion through said upper and lower ends thereof, respectively, to form a top wall and a bottom wall, respectively, of said die cavity, said body portion including gas outlet ports near said upper end and further including the steps of moving said plunger members to develop a cavity larger than the volume of said powder mixture used to form said compact body, locating said top plunger after placing said powder material in said die cavity to define a free space above said powder mixture, said free space communicating with said gas outlet ports to permit degassing of said powder mixture during said forming process.

29. The method of claim 28 further including the step of periodically alternately moving said top plunger member into and out of said die cavity thereby to release the pressure on said mixed powders during application of said sintering temperature to remove free gases from said mixed powders.

30. The method of claim 15 wherein a porous element forms a boundary of said die cavity, said element having surface pores, and further including the step of applying sufficient pressure to force said mixed powders into said pores, thereby to join said mixed powders to said element.

31. The method of claim 30 wherein said porous element comprises graphite and said mixed powders comprise metallic particles to form a graphite coated conductor.

32. The method of claim 15 wherein a porous graphite element forms a boundary of said die cavity and a layer of graphite powder is disposed between said graphite element and said mixed powders.

33. The method of claim 32 wherein said graphite powder is formed by applying heat to said layer.

34. The method of claim 33 wherein said mixed powders are compressed at a pressure on the order of 10,000 kg. $cm^{-2}$ and a vacuum on the order of $3\times10^{-6}$ torr is applied in said chamber.

35. The method of forming a multiple layered conducting member including a graphite portion having a surface defining a plurality of surface pores and a conductive portion formed of particles, comprising the steps of providing a die cavity having an opening and plunger means receivable and movable in said opening, partially filling the die cavity with a first layer of said particles and a second layer of graphite powder, locating said plunger means in said opening adjacent the graphite powder, thereby to partially close the die cavity, locating the die cavity in a vacuum chamber, forming a vacuum in said chamber, heating the die cavity, particles and graphite powder to less than the melting temperature of said graphite powder and to a sintering temperature, incrementally moving said plunger means into said opening to incrementally compress said particles and graphite powder in the presence of the vacuum and sintering temperature.

36. The method of claim 35 wherein said particles are conductive.

37. The method of claim 35 wherein said particles are initially non-conductive and become conductive as a result of the forming process.

38. Apparatus for vacuum hot pressing metallic powder to form a compact body usable as an electrical contact comprising a die assembly having a cavity for containing a predetermined quantity of loose powder reaching a predetermined level therein and at least one movable die closure means movable into and out of said cavity for compressing said powder, said die assembly having outgassing opening means communicating with said cavity and placed inwardly of the movable die closure means and outwardly of the level of said powder, a chamber including means to create a vacuum therein, said chamber including heating means, means for mounting said die assembly in heating relation with heating means in said chamber for heating said powder to a predetermined temperature in said cavity, and pressure applying means mounted incrementally for moving said die closure means into said cavity incrementally for compacting said powder, said heated and compacted powder forming said compact body.

39. The apparatus of claim 38 wherein said pressure applying means is operable in time spaced steps for sequentially increasing and decreasing the pressure applied to said powder.

40. In the apparatus of claim 38 wherein said die assembly includes a tubular die body having open upper and lower ends and said die closure means includes upper and lower plungers positioned in respective upper and lower ends of said die body, said lower plunger having breakable support pins for supporting said die body, said upper plunger having breakable support pins resting on said die body and supporting said upper plunger in spaced relation to said outgassing opening means, said support pins breaking upon the application of a predetermined pressure to said plungers to provide a floating die body and, thereby permitting full entry of said plungers into said die body incrementally for compacting said powder.

41. In the apparatus of claim 40 wherein said tubular die body includes an inner wall formed by an axially split, multiple segment die insert formed of graphite, said insert being removable from said die body.

42. In the apparatus of claim 40 wherein said upper and lower plungers are cup-shaped and wherein said die assembly further includes an inner die insert for defining an annular cavity into which said cup-shaped plungers project the inner die insert defining a central opening in a resulting compact body produced by said apparatus.

43. The method of forming a compact body of powdered material for producing an electrical contact, comprising the steps of;

providing a die assembly including a die cavity and means for applying pressure therein;

maintaining said powdered material in an inert gas atmosphere;

placing said powdered material in said die cavity;

transferring said die assembly including said powdered material into a vacuum chamber;

forming a vacuum in said chamber to remove gases from said powdered material;

operating said pressure applying means to produce a predetermined pressure in said cavity against said powdered material;

slowly heating said die assembly including said powdered material, to a temperature just below the melting point of said powdered material;

incrementally operating said pressure applying means for additional removal of gases from said powdered material and to form said compact body.

44. The method of forming a compact body as claimed in claim 43 further including the steps of cooling said die assembly while maintaining approximately 400 kg $cm^{-2}$ pressure on said powdered material and after said die assembly is cooled, removing said compact body therefrom.

45. The method of forming a compact body as claimed in claim 44 further including the steps of applying an inert gas to said die assembly to enhance the cooling of said compact body.

46. The method of forming a compact body as claimed in claim 43 wherein said steps of slowly heating said die assembly includes the steps of coupling an inductive heating coil to said die assembly and operating said coil at a predetermined frequency for inductively heating said die assembly.

47. The method of forming a compact body as claimed in claim 43 wherein said powdered material includes copper paticles, the maximum pressure applied to said powdered material is approximately 400 kg. $cm^{-2}$, wherein the vacuum pressure in said chamber is approximately $3\times10^{-6}$ torr and wherein the temperature reached in said die assembly is approximately 1080° C., just below the melting point of copper.

48. The method of forming a compact body as claimed in claim 43 wherein the primary constituent of said powdered material comprises copper powder and a second constituent comprises zirconium diboride in the amount of 0–75% by weight.

49. The method of forming a compact body as claimed in claim 48 wherein the amount of said zirconium diboride is 0–2% by weight.

50. The method of forming a compact body as claimed in claim 43 wherein a major constituent of said powdered material comprises copper powder and wherein a minor constituent of said powdered material comprises oxygen in the amount of 0–3% by weight.

51. The method of forming a compact body as claimed in claim 50 wherein said oxygen is included in an amount of 270 parts per million by weight.

52. The method of forming a compact body as claimed in claim 43 wherein said powdered material comprises first and second materials; said first material being of high conductivity with a first component selected from the group consisting of silver, gold, aluminum, beryllium, magnesium, calcium, nickel, indium, rhodium, cobalt, iridium and zinc; and a second component selected from the group consisting of copper, silver, gold, aluminum, beryllium, magnesium, calcium, strontium, barium, scandium, zinc, yttrium, lanthanum, titanium, zirconium, hafnium, vanadium, indium, niobium, tantalum, chromium, molybdenum, tungsten, manganese, technetium, rhenium, iron, ruthenium, osmium, cobalt, rhodium, iridium, nickel, palladium, platinum, boron, carbon, silicon, germanium, the actinides and the lanthanides and a second material selected from the group consisting of boride, phosphide, oxide, nitride, silicide, carbide, halide, arsenide, selenide, telluride, antimonide and sulfide.

* * * * *